United States Patent [19]

Malarsky

[11] 4,116,035

[45] Sep. 26, 1978

[54] DENT PULLER

[76] Inventor: Frank Malarsky, 27 Chamberlain Pkwy., Worcester, Mass. 01602

[21] Appl. No.: 831,493

[22] Filed: Sep. 8, 1977

[51] Int. Cl.[2] ..... B21C 1/12

[52] U.S. Cl. ..... 72/389; 72/705

[58] Field of Search ..... 72/705, 389

[56] References Cited

U.S. PATENT DOCUMENTS

| | | | |
|---|---|---|---|
| 2,949,144 | 8/1960 | Dredske et al. | 72/705 X |
| 3,088,513 | 5/1963 | Marquardt | 72/705 X |
| 4,040,287 | 8/1977 | Wivinis | 72/705 X |
| 4,050,271 | 9/1977 | Jones | 72/705 X |

*Primary Examiner*—C.W. Lanham
*Assistant Examiner*—D. M. Gurley
*Attorney, Agent, or Firm*—Charles R. Fay

[57] ABSTRACT

Repairing dents as in automobile bodies through the use of a tool having an appliance to underlie the dent approximately at the center thereof and to withdraw the dent to its approximate original location by means of a hand operated tool including a rod retracting the material of the dent in increments, retraction of the rod being inhibited by a cockable washer. The provision of extra wide detachable legs for straddling the dents so that larger dents can be processed, said legs being mounted on a bracket which holds the rod.

5 Claims, 10 Drawing Figures

DENT PULLER

BACKGROUND OF THE INVENTION

In the repair of dents e.g. automobile bodies, doors, etc., it is the practice to make a hole in the dent at approximately the center thereof, inserting an appliance underneath the material surrounding the hole formed, said appliance being at the end of a rod or the like, and then using a hammer or mallet to retract the rod to retract the material of the dent to its more or less original position. This requires the use of a certain degree of skill which can only be acquired through usage; and it is the object of the present invention to provide a new and useful dent puller which requires a minimum of skill and learning time in which to operate the same by retracting the dent puller rod by supporting the dent puller rod in a position surrounding the dent and using controlled means for retracting the dent puller rod in increments.

SUMMARY OF THE INVENTION

A dent puller rod is provided which is slidably mounted on a U-shaped bracket the operative end of the rod being located between the legs of the bracket and having detachably mounted at its end means for puncturing and underlying the material of the dent adjacent the center thereof, together with means under manual control for retracting the dent puller rod in certain controlled increments so that the skill required by the prior art is greatly lessened, the pulling of the dent by means of the new dent puller being almost automatic. The rod is prevented from being retracted by a cockable washer.

The invention also contemplates the use of magnetic legs attached to the ends of the legs of the U-shaped bracket and diverging from each other to straddle a much larger dent than is possible merely with the U-shaped bracket alone. Where the dent is small the additional legs are not necessary but where the dent is a larger one which is usually the case the additional legs can be easily attached to the dent puller rod bracket in order to straddle the larger dent and render it much easier to pull out. The magnetic legs anchor the device to the car body in the region of the dent.

PREFERRED EMBODIMENT OF THE INVENTION

Figure 1:
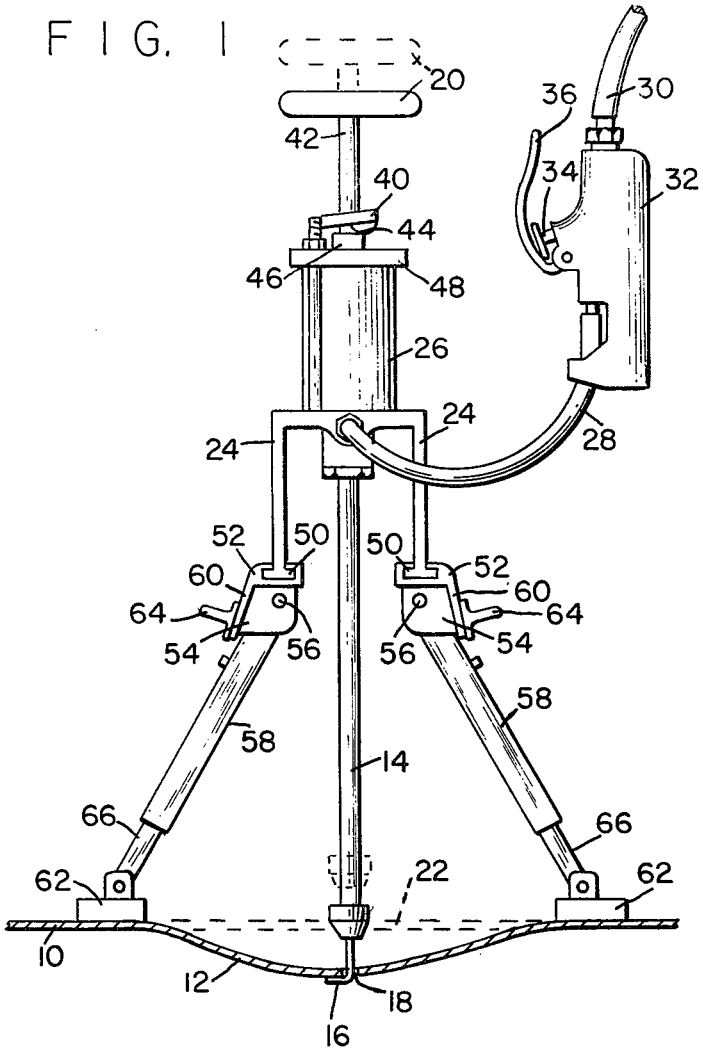
FIG. 1 is a view in elevation illustrating the invention.

Referring to FIG. 1 the surface material of a vehicle is indicated at 10 having a dent 12 therein. A dent puller rod 14 is provided with a detachable appliance 16. As is well-known, a hole 18 is formed in the general center of the dent and the dent puller rod 14 with a screw at the end thereof or the angled appliance 16 is engaged in the hole in such a way that upon pulling upon the handle of the rod at 20 or hitting the same with a mallet the dent is pulled up and back towards its original position shown in dotted line 22, whereupon the surface of the material is refinished also all is well-known.

In the present case a U-shaped bracket having the legs 24,24 is used to support a piston and cylinder of well-known construction and indicated generally at 26 for the purpose of retracting the rod under the influence of air under pressure supplied through a hose 28, therebeing another hose 30 going to a source of air under pressure. A normally closed valve 32 is provided with a valve actuator 34 operated by a manually operated handle 36 so that the operator conveniently squeezes the handle for a short interval of time causing the piston to retract in small increments so that the exact original position 22 is easily provided, rather than guessed at, as for instance in the prior art, where the rod 14 is retracted either manually or by the use of a mallet.

In order to keep the rod 14 from slipping downwardly, a one way cockable washer 40 is provided surrounding rod 14 in the upper area thereof which is indicated at 42 in FIG. 1. This washer is provided with a built up area 44 impinging on a abutment 46 on the head 48 of the air cylinder. This washer lifts with each increment of lifting of the rod 42 but falls back cocked in such a way as to grip opposite side edges of the rod 42 and hold it in its elevated position.

It will be seen that the increments are under control of the operator but the rod itself is under control of the air cylinder not under manual control thereof which would require skill in the operation thereof, so that the precise position desired in repairing the dent can be easily achieved by less skillful operators merely by operating the valve handle 36 at intervals.

Ordinarily the legs 24,24 of the bracket supporting the air cylinder are spaced apart enough to process a small dent but where larger dents such as in FIG. 1 are present, the invention provides extension legs which diverge to straddle the large dent.

The bracket legs 24,24 have T-head terminations or feet 50 upon which are slidably mounted channel members 52 of brackets 54 pivotally mounting as at 56 the extension legs 58,58. These extension legs limited in spread and held at the angle shown by the bracket rear-faces 60,60 and at their lower ends terminate in pivoted magnetic feet 62,62 which position the entire apparatus firmly at a desired location.

Reference numerals 64 indicate manually operated screws for positioning the legs and the legs themselves may be telescopic as illustrated at 66 with holes 68 showing the different degrees of adjustment thereof. Of course the further out the telescopic legs 66 extend the wider apart will be the magnetic feet 62.

Figure 3:
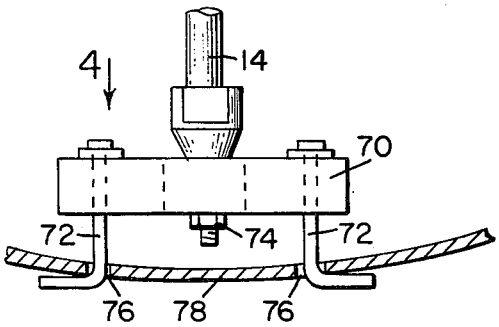
FIG. 3 illustrates an appliance for insertion at the bottom of the dent.
Figure 4:
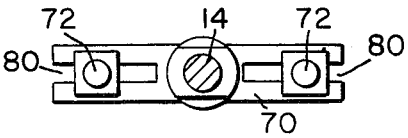
FIG. 4 is a plan view partly in section looking in the direction of arrow 4 in FIG. 3.
Figure 7:
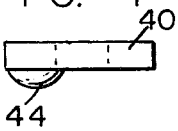
FIG. 7 is an enlarged view of the cockable washer employed in FIG. 1.
Figure 8:
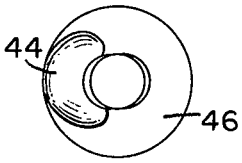
FIG. 8 is a bottom plan view thereof.

FIGS. 3 and 4 show an improved puller appliance comprising a bar 70 having spaced apart L-shaped puller members 72,72, the bar being secured by a screw and nut 74 and each L-shaped puller member 72 extending through separate spaced holes 76,76 in the material of the dent 78. The puller members 72,72 are adjustably mounted in slots 80.

Figure 5:
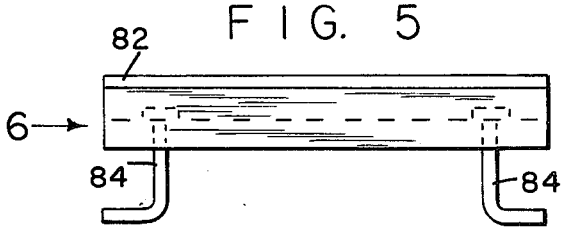
FIG. 5 shows a variation of the apparatus of FIG. 3.
Figure 6:
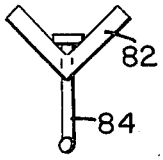
FIG. 6 is an end view thereof looking in the direction of arrow 6 in FIG. 5.

FIGS. 5 and 6 show a V-shaped angle 82 having dent pullers 84 adjustably mounted therein as in FIG. 4, this appliance being especially adapted for processing sharper creases which often happen in scraping accidents where the dent is not merely a pushed in circular member as happens from a sharp blow.

Figure 2:
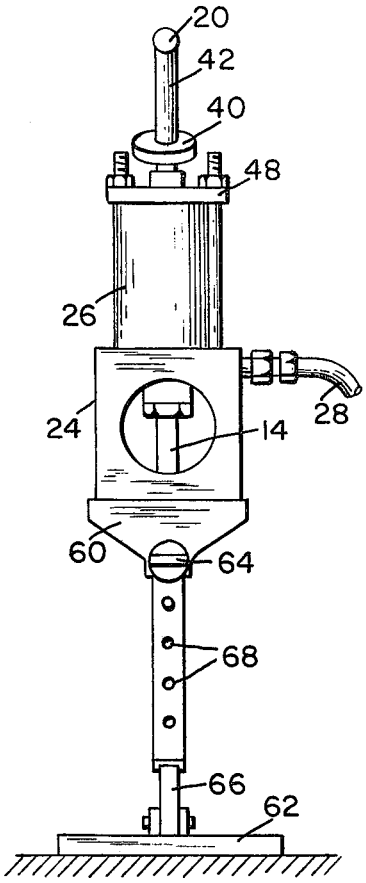
FIG. 2 is a view in side elevation thereof.
Figure 9:
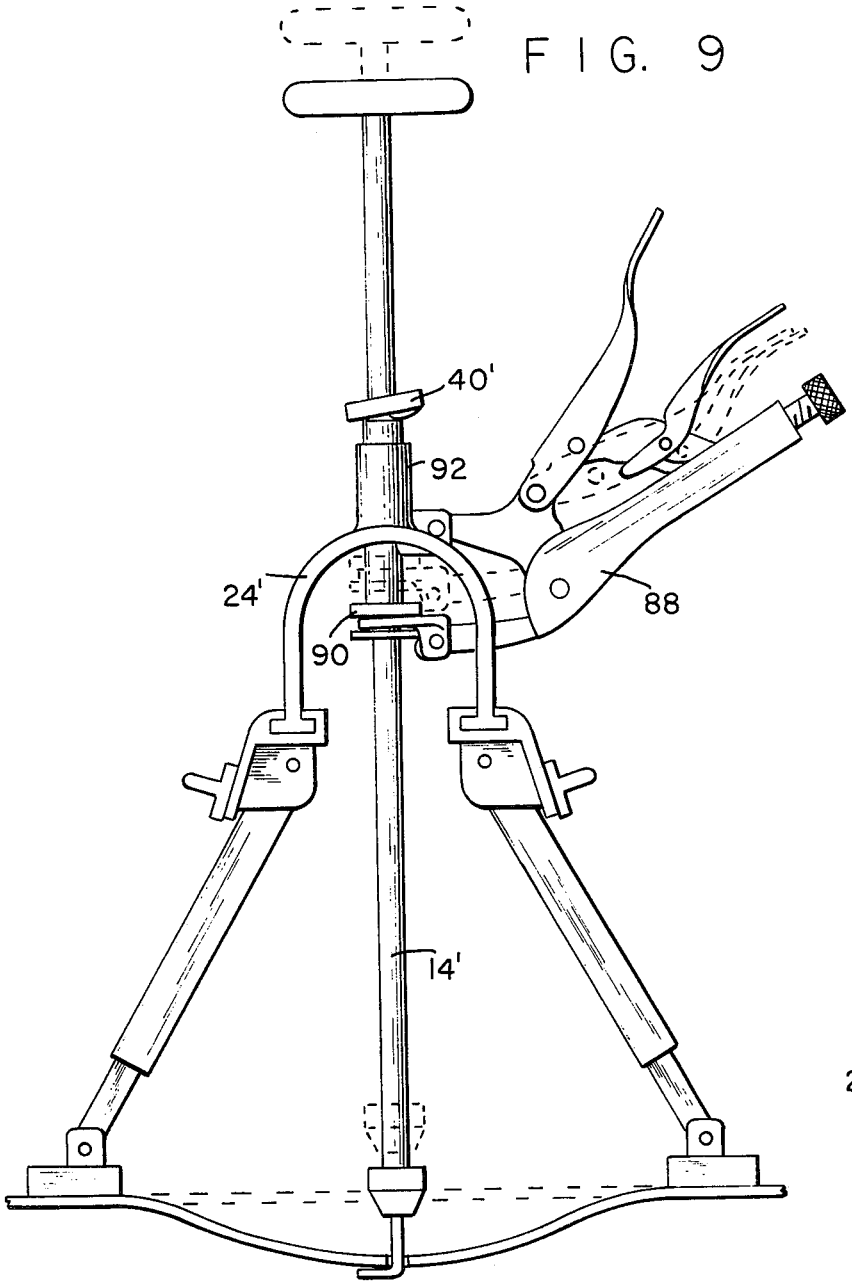
FIGS. 9 and 10 illustrate a modification.
Figure 10:
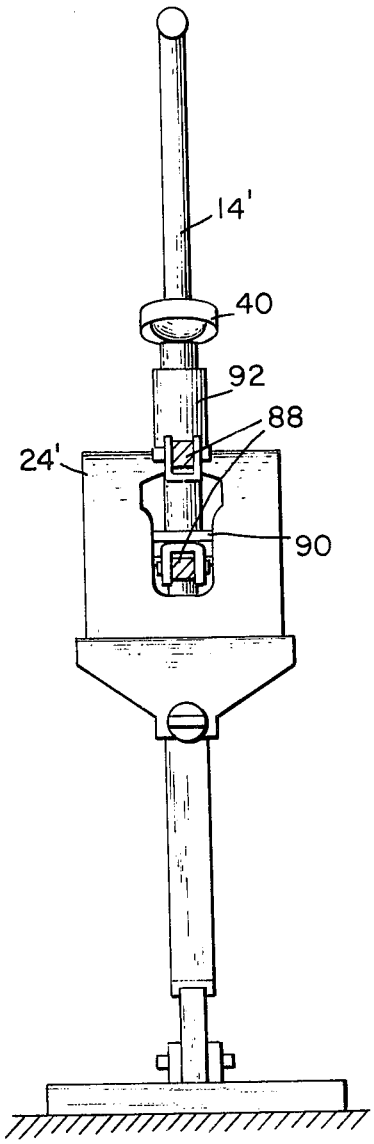

FIGS. 9 and 10 illustrate a modification wherein an adjustable type pliers 88 serves to raise an abutment 90 fixed to the rod 14' thereby raising the rod in increments as before. The cockable washer 40' acts as above described, finding a stop at the top edge of a ferrule 92 on the arched bracket 24'. Otherwise all the parts are the same as in FIGS. 1 and 2 and operate in the same way.

I claim:

1. A dent puller comprising an inverted solid single U-shaped bracket, said bracket including legs, means on said bracket midway between the legs of the U, for holding a slidable dent puller rod thereon, said dent puller rod extending through said bracket and having a handle at one end and a dent puller tool at the opposite end thereof, mechanical means for retracting said dent puller by increments, and a cockable washer on said rod automatically acting to prevent motion of the dent puller rod in the opposite direction, said mechanical means for moving said dent puller rod in increments being under control of the operator, a pair of separate extension legs, means on each leg of the U-shaped bracket to receive and detachably hold one of said extension legs, said extension legs diverging and being adapted to straddle a larger dent than could be straddled by the U-shaped bracket, means mounted said extension legs relative to the respective bracket leg for pivotal motion thereon, and means restraining said pivotal motion in a direction separating the extension legs.

2. The dent puller of claim 1 wherein said extension legs are telescopic and including means for holding the same in adjusted position.

3. The dent puller of claim 1 wherein the means for moving the rod in increments include means for manually controlling the same.

4. The dent puller of claim 3 wherein said means includes air under pressure, and a normally closed valve therefor together with means for selectively opening said valves.

5. The dent puller according to claim 1 wherein the means on the legs of the U-shaped bracket to receive and detachably hold the extension legs comprises inverted T-shaped members and including undercut means on the extension legs for sliding over the T-shaped heads for attachment thereto.

* * * * *